United States Patent [19]

Wu

[11] Patent Number: 4,961,718

[45] Date of Patent: Oct. 9, 1990

[54] TOY PISTOL WITH A BALL BULLET

[76] Inventor: Szu-Hua Wu, 1-2, Lane 975, Tsunjih Road, Taoyuan, Taiwan

[21] Appl. No.: 476,585

[22] Filed: Feb. 7, 1990

[51] Int. Cl.[5] ..... A63H 5/04; A63H 33/30; F41B 11/00; F41C 3/00

[52] U.S. Cl. ..... 446/406; 446/473; 124/65; 42/55; 42/58

[58] Field of Search ..... 446/406, 405, 407, 404, 446/397, 473; 124/48, 85, 65; 42/54, 58, 55

[56] References Cited

U.S. PATENT DOCUMENTS

| | | | |
|---|---|---|---|
| Re. 24,967 | 4/1961 | Weimer | 42/58 |
| 962,972 | 6/1910 | Nielsen | 42/54 |
| 1,114,950 | 10/1914 | Wegener | 446/407 |
| 1,211,870 | 1/1917 | Newton | 446/407 |
| 2,505,428 | 4/1950 | Pope | 124/65 |
| 2,762,356 | 9/1956 | Foster | 446/405 X |
| 3,087,481 | 4/1963 | Foster | 446/405 X |
| 3,219,023 | 11/1965 | Ryan | 446/473 X |
| 4,598,491 | 7/1986 | Noble | 42/58 |

FOREIGN PATENT DOCUMENTS

| | | | |
|---|---|---|---|
| 2158725 | 7/1972 | Fed. Rep. of Germany | 446/473 |

*Primary Examiner*—Robert A. Hafer
*Assistant Examiner*—D. Neal Muir
*Attorney, Agent, or Firm*—Morton J. Rosenberg; David I. Klein

[57] ABSTRACT

This invention relates to a toy pistol with a ball bullet and in particular to one characterized in a ball bullet which will rotate in unison with a bullet seat when the trigger is pressed and which will produce a cracking noise as the hammer hits thereon. Hence, the pistol may produce continuous cracking noise without replacing bullets.

1 Claim, 3 Drawing Sheets

TOY PISTOL WITH A BALL BULLET

BACKGROUND OF THE INVENTION

This invention related to a toy pistol with a ball bullet.

It is found that the conventional toy pistol has the following drawbacks:

1. The cylinder can only receive twelve bullets at the most and so it is often necessary to load new bullets.

2. The bullet is composed of a plastic container filled with powder so that the cracking sound produced thereby is not very loud. Thus, in order to produce louder cracking sound, it is required to fill more powder into the plastic container which may, however, cause danger to the player.

3. About 30% of the bullets will not produce cracking sound because of inaccurate impact between the hammer and the bullet as well as incomplete loading of the bullets.

It is, therefore, an object of the present invention to provide a toy pistol with a ball bullet which may obviate and mitigate the above-mentioned drawbacks.

SUMMARY OF THE INVENTION

This invention relates to a toy pistol with a ball bullet.

It is the primary object of the present invention to provide a toy pistol with a ball bullet which can produce a cracking noise for more than one hundred times.

It is another object of the present invention to provide a toy pistol with a ball bullet which will not eject solid bullets thereby ensuring safety.

It is still another object of the present invention to provide a toy pistol with a ball bullet which is economic to fabricate.

It is still another object of the present invention to provide a toy pistol with a ball bullet which is simple in construction.

It is a further object of the present invention to provide a toy pistol with a ball bullet which is durable in use.

Other objects and merits and a fuller understandings of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
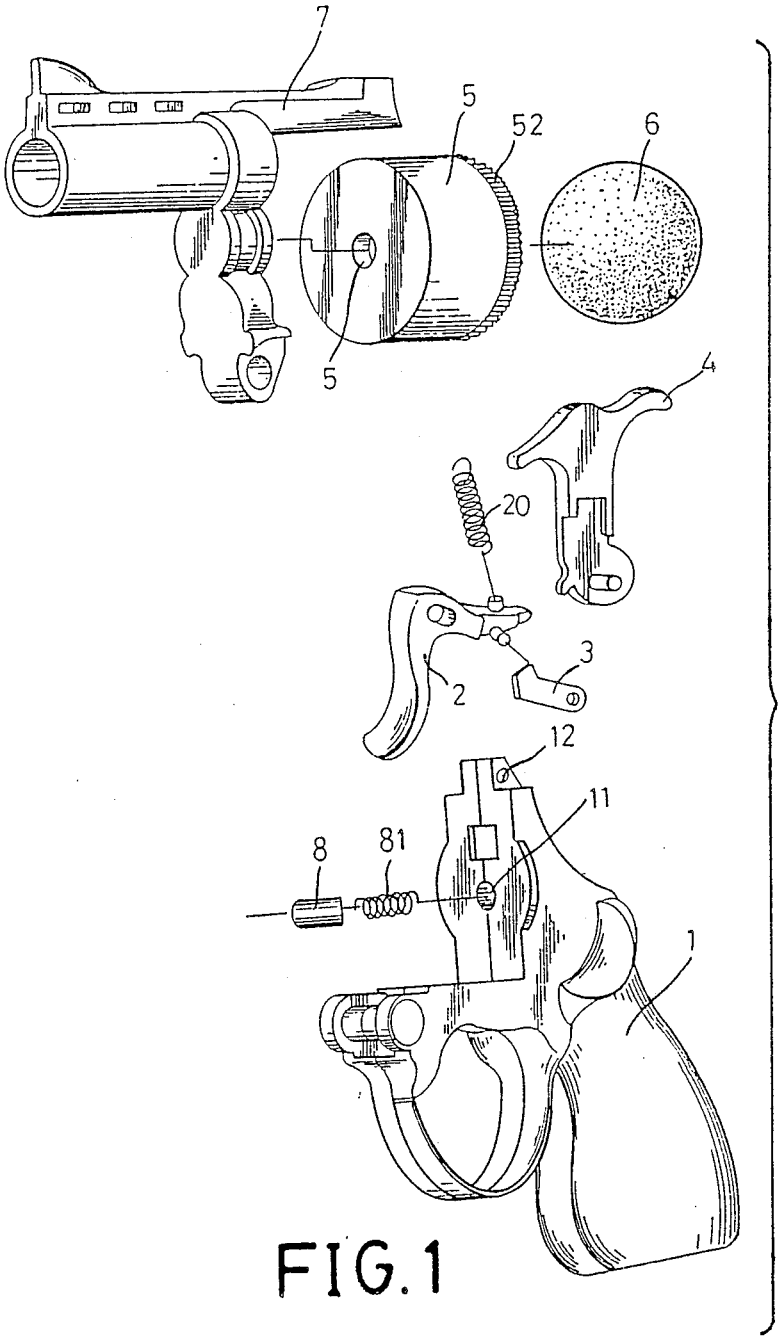
FIG. 1 is a perspective view of a toy pistol with a ball bullet according to the present invention.
Figure 2:
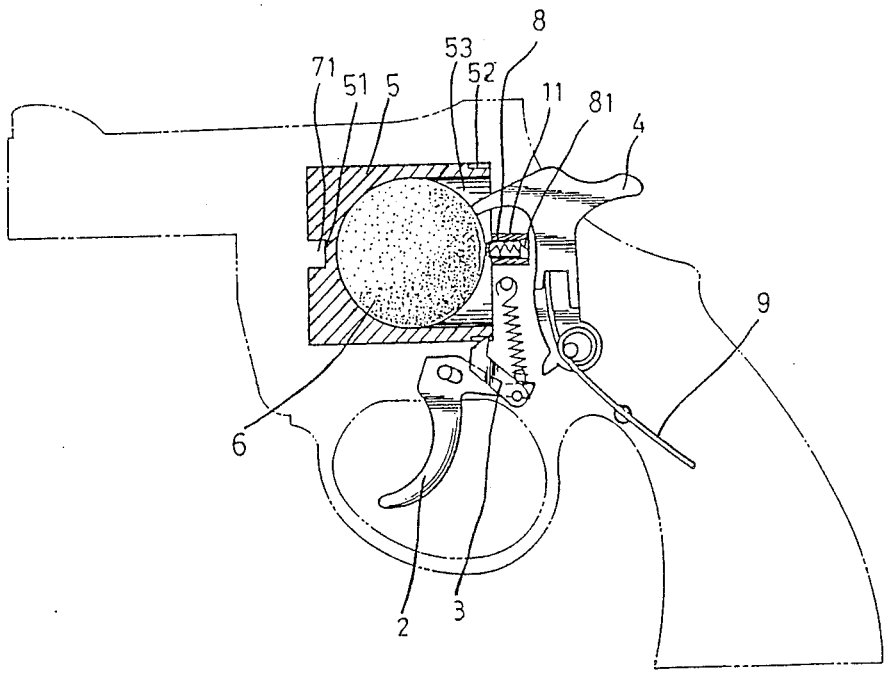
FIG. 2 is a cutaway view showing the connection between the component parts of the toy pistol with a ball bullet.

Referring to the drawings and in particular to FIG. 1, the toy pistol according to the present invention comprises a body 1, a trigger 2, a push rod 3, a hammer 4, a bullet seat 5, a ball bullet 6, a barrel 7 and a pin 8. As shown in FIG. 2, the bullet seat 5 is a cylindrical member 5 with a center hole 51 at one end adapted to receive a protuberance 71 of the barrel 7 so that the bullet seat 5 can be rotated with respect thereto. Further, the bullet seat 5 has a plurality of threads 52 at the other end and a recess 53 for receiving the ball bullet 6. A blind hole 11 is formed in the vertical surface of the body 1, in which a spring 81 and a pin 8 are placed in sequence so that the pin 8 tends to be pushed outwards by the spring 81. In addition, the upper end of the body 1 has two spring-loaded balls 12 to keep the barrel 7 in position.

With reference to FIG. 2, the structure of the body 1, the barrel 7, the trigger 2 and the hammer 4 are known in the art and will not be described here in detail. In assembly, the ball bullet 6 is first placed in the cylindrical member 5 and the barrel 7 is engaged with the body 1 and kept in position by the spring-loaded balls 12. Meanwhile, the pin 8 disposed in the body 1 exerts a force to place the ball bullet 6 in the bullet seat 5. Since the pin 8 has a rounded head and can be totally pressed into the blind hole 11, the barrel 7 will not be blocked in opening or closing. Moreover, the end of the push rod 3 is connected to the trigger 2 while the front end thereof bears against the thread 52 on the surface of the bullet seat 5.

Figure 3:
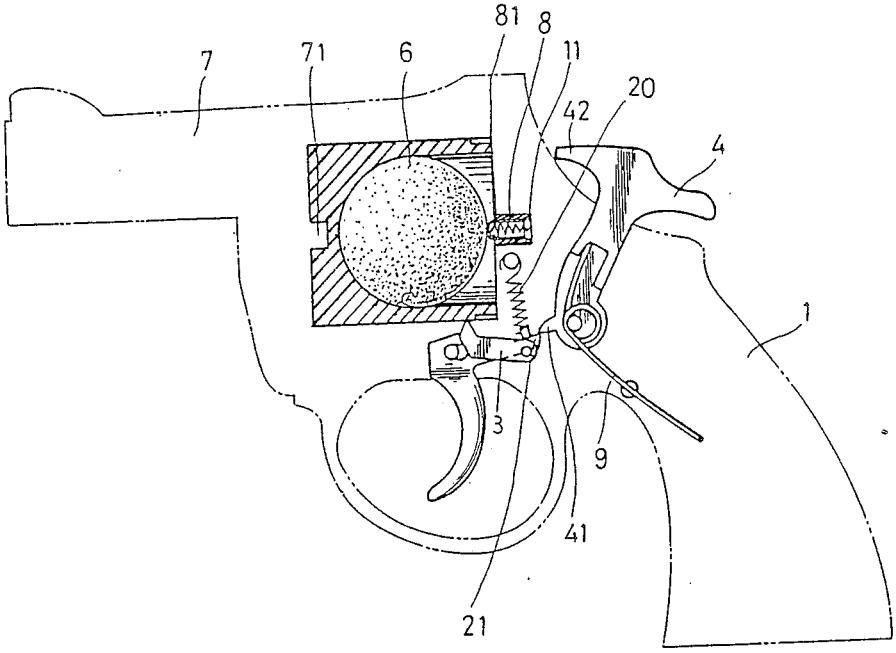
FIG. 3 shows how the toy pistol with a ball bullet works.

Looking now at FIG. 3, when the trigger 2 is pressed, the hammer 4 and the push rod 3 will be actuated to move. As the trigger 2 reaches to the end of its stroke, the protuberance 41 at the bottom of the hammer 4 will be released from the tip 21 of the trigger 2 and the spring 9 will force the head 42 of the hammer 4 to hit the ball bullet 6 in the bullet seat 5 thereby producing a cracking noise. In the meantime, the push rod 3 forces the bullet seat 5 to rotate through an angle hence turning the ball bullet 6 through an angle and waiting for next hitting. The trigger will then be returned to its original position by the spring 20.

The ball bullet 6 is a porcelain ball coated with a layer of safety powder so that when the head 42 of the hammer 4 hits on the surface of the bullet 6, a cracking noise will be produced. In the meantime, the ball bullet 6 will be rotated in unison with the bullet seat 5 when the trigger 2 is pressed and so the hammer 4 hits on a different point of the bullet every time thereby causing the present invention to produce continuous cracking noise. As the ball bullet 6 has rotated through 360 degrees, simply rotate the ball bullet so as to change the hitting surface hence enabling the ball bullet to be used completely.

Although the present invention has been described with a certain degree of particularity, it is understood that the present disclosure is made by way of example only and that numerous changes in the construction and the combination and arrangement of parts may be resorted to without departing from the spirit and scope of the invention as hereinafter claimed.

I claim:

1. A toy pistol with a ball bullet comprising:

a body having on the vertical surface a blind hole in which a spring and a pin are placed in sequence and on the upper end two spring-loaded balls;

a barrel pivoted on said body and being able to be kept in position by the two spring-loaded balls of said body;

a bullet seat being a cylindrical member having threads on one end and a center hole at the other end adapted to receive a protuberance of said barrel such that said bullet seat may be rotated with respect thereto;

a ball bullet coated with safety powder and received in the bullet seat;

a trigger pivoted on said body;

a spring-loaded push rod pivotally connected at one end with said trigger and engaged with one of said threads on said bullet seat; and a spring-loaded hammer pivoted on said body and being able to be actuated by said push rod;

whereby when said trigger is pressed, said hammer and said push rod will be actuated to move and when said trigger reaches to the end of the stroke thereof, said hammer will be released to hit said ball bullet thereby producing a cracking noise.

* * * * *